United States Patent [19]

Mirtich, Jr. et al.

[11] 4,218,633

[45] Aug. 19, 1980

[54] HYDROGEN HOLLOW CATHODE ION SOURCE

[75] Inventors: Michael J. Mirtich, Jr., N. Olmsted; James S. Sovey, Strongsville; Robert F. Roman, Brookpark, all of Ohio

[73] Assignee: The United States of America as represented by the Administrator of the National Aeronautics and Space Administration, Washington, D.C.

[21] Appl. No.: 953,391

[22] Filed: Oct. 23, 1978

[51] Int. Cl.[2] ..... H01J 17/26

[52] U.S. Cl. ..... 313/362; 313/231.4

[58] Field of Search ..... 313/231.4, 362, 361, 313/359

[56] References Cited

U.S. PATENT DOCUMENTS

| | | | |
|---|---|---|---|
| 3,113,427 | 12/1963 | Meyer | 313/359 |
| 3,238,715 | 3/1966 | Reader et al. | 313/361 X |
| 3,345,820 | 10/1967 | Masek | 313/362 X |
| 3,728,861 | 4/1973 | Pawlik et al. | 313/204 X |

*Primary Examiner*—Robert Segal

*Attorney, Agent, or Firm*—Norman T. Musial; John R. Manning; James A. Mackin

[57] ABSTRACT

A source of hydrogen ions is disclosed and includes a chamber having at one end a cathode which provides electrons and through which hydrogen gas flows into the chamber. Screen and accelerator grids are provided at the other end of the chamber. A baffle plate is disposed between the cathode and the grids and a cylindrical baffle is disposed coaxially with the cathode at the one end of the chamber. The cylindrical baffle is of greater diameter than the baffle plate to provide discharge impedance and also to protect the cathode from ion flux. An anode electrode draws the electrons away from the cathode.

The hollow cathode includes a tubular insert of tungsten impregnated with a low work function material to provide ample electrons. A heater is provided around the hollow cathode to initiate electron emission from the low work function material.

6 Claims, 2 Drawing Figures

HYDROGEN HOLLOW CATHODE ION SOURCE

ORIGIN OF THE INVENTION

This invention was made by employees of the United States Government and may be manufactured and used by or for the Government without the payment of any royalties thereon or therefor.

BACKGROUND OF THE INVENTION

1. Field of the Invention

This invention relates to ion sources and is directed more particularly to a high current density ion source suitable for heating plasmas in controlled thermonuclear reaction experiments. Ion source modules which produce ion beams at 40 kv and ion current densities of $0.5A/cm^2$ have advanced to a rather sophisticated state of development. However, in the future, fusion test reactors will require multimegawatt neutral beams, each comprising a multiplicity of ion source modules. These modules will be exposed to the radioactive environment of the fusion reactor. Thus, highly reliable ion sources operating at high duty cycles will be required in order to expedite and simplify remote maintenance, handling and adjustment. In order to satisfy the neutral injection requirements for high beam currents, discharge currents ranging from 10 to 40 times the beam current will be required.

2. Prior Art

Prior art ion sources for neutral injection achieve the necessary discharge current by employing a relatively large number of filament cathodes which operate at temperatures approaching 3000° K. The lift of such cathodes is limited by high thermal stress, sublimation and ion sputtering. Furthermore, heat radiated from the filament may cause undesirable thermal loads on critical components such as the ion optics.

Hollow cathodes have been used for ion thrusters and in inert gas ion sources.

OBJECTS AND SUMMARY OF THE INVENTION

It is an object of the invention to provide a high current density ion source having greatly extended life as compared to the prior art.

It is another object of the invention to provide an ion source which operates at high temperatures with no liquid cooling required.

Still another object of the invention is to provide an ion source which provides the high current density beam of hydrogen or deuterium.

It is yet another object of the invention to provide an ion source having baffles which reduce heating of the cathode resulting from ion bombardment.

An additional object of the invention is to provide an ion source wherein the geometry of the baffles coacts with the magnetic field and the flow rate of the hydrogen or deuterium to control the discharge electrical impedance.

In summary, the invention provides a high current density hydrogen ion source utilizing a hollow cathode and suitably arranged baffles to reduce self heating of the cathode and to effect the electron and ion flow in a manner such as to desirably aid in controlling discharge impedance.

DESCRIPTION OF A PREFERRED EMBODIMENT

Figure 1:
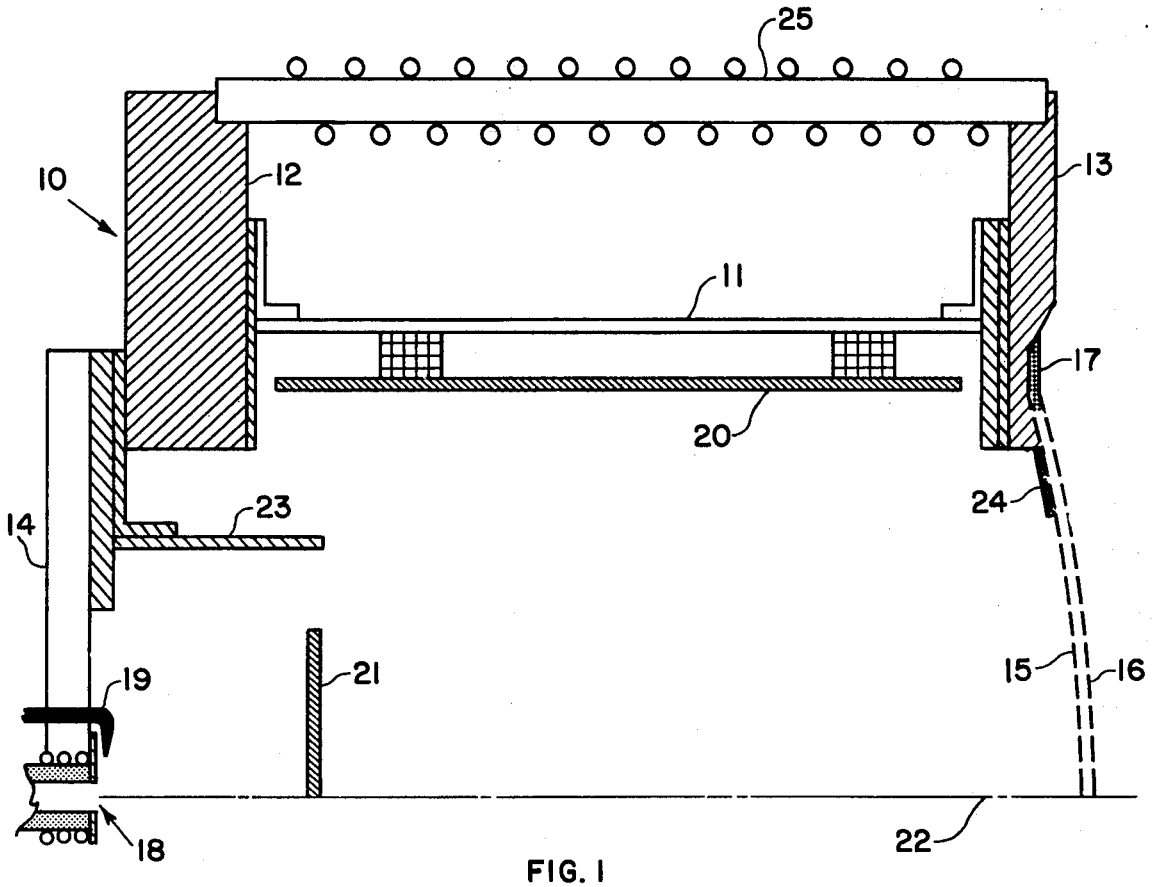
FIG. 1 is a half axial section of a hydrogen ion source built in accordance with the invention.

Referring to FIG. 1 there is shown a hydrogen ion source 10 comprised of a cylindrical shell 11 having an annular magnetic pole piece 12 at one end and a second annular pole piece 13 at the other end. A back plate 14 of stainless steel or the like is attached to the pole piece 12.

At the downstream end of ion source 10 there is provided a screen grid 15 and an accelerator grid 16 insulated from one another by a spacer 17 which is preferably mica. The grids 15 and 16 together with the mica spacer 17 are supported on the annular pole piece 13.

A hollow cathode 18 through which hydrogen gas is injected into the ion source is disposed in an aperture in the back plate 14.

An igniter electrode 19 also extends through the back plate 14 adjacent the hollow cathode 18. When pulses of high voltage are applied between the cathode 18 and the igniter 19, an electrical breakdown occurs between electrodes 18 and 19 and subsequently a discharge is established between cathode 18 and cylindrical anode 20. The anode 20 is at a positive voltage with respect to the cathode 18 and is disposed radially inwardly of the shell 11. The hydrogen atoms which lose electrons thus become positive charged ions.

To the end that ions produced as just described will be directed through the grids 15 and 16 with maximum efficiency and to the end that the ion source will have a useful life many times greater than those of the prior art, a baffle plate or disc 21 is disposed on the axis 22 of the ion source 10 and a cylindrical ring 23 coaxial with the axis 22 is attached to the back plate 14. The inside diameter of cylinder 23 is substantially greater than the diameter of baffle 21 leaving an annular space between them. The baffle 21 and 23 serve to prevent ions from bombarding the cathode 18 which would seriously shorten its life and, further, affect the discharge impedance of the ion source as will be discussed presently.

At the downstream end of the ion source 10 an annular ring 24 extends radially inwardly from pole piece 13 to serve as an ion optic mask. This mask adjusts the diameter of the ion beam.

In order to enhance ion utilization efficiency of the hydrogen ion source 10, a plurality of elongated electromagnets 25 are disposed outwardly of shell 11 extending between the pole pieces 12 and 13. These electromagnets with the pole pieces 12 and 13 produce a magnetic field inside the cylindrical shell 11.

Figure 2:
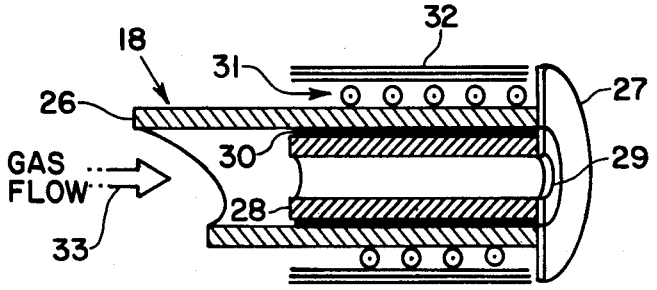
FIG. 2 is an axial section of the cathode of FIG. 1 showing the construction thereof in greater detail.

Referring now to FIG. 2, there is shown the hollow cathode 18 of FIG. 1 in more detail. As shown, hollow cathode 18 comprises a cathode tube 26 having at one end an annular radiation flange 27. Disposed coaxially in tube 26 is a porous tungsten tube 28. An orifice plate 29 is nested in radiation flange 27. The space between the tube 28 and the tube 26 is filled with an electrically conductive, refractory material as, for example, molybdenum foil to position the tube 28 and to provide good electrical conductivity between tubes 26 and 28.

The tungsten tube 28 is impregnated with a low work function material to provide electrons when cathode 18 is heated. Barium calcium aluminate is an example of one suitable low work function material.

To heat the cathode to provide electrons for starting the hydrogen ion source, a swaged heater 31 is disposed around the outside of cathode tube 26 extending from radiation flange 27 to the end of tube 28 opposite the orifice plate. To efficiently heat the porous tungsten tube 28, radiation shields are placed outwardly of the heater. These shields are preferably tantalum foil although other refractory metals could be used.

An arrow 33 indicates the flow of hydrogen gas into the hollow cathode 18. The gas will exit through the orifice plate 29 into the ion source 10.

Referring back again to FIG. 1, the shell 11, the anode 20 and the pole pieces 12 and 13 are covered with refractory metal foils which serve as radiation shields not shown. This construction allows the magnets to operate temperatures much lower than the anode or shell whose temperatures exceed 1000° C. during continuous operation. The geometry of the baffles 21 and 23, the flow rate of the hydrogen through the hollow cathode 18 and the magnetic field strength in the chamber coact to determine the discharge electrical impedance of the ion source.

The shell 11 with the cathode 18 and screen grid 15 operate at high positive potential. Anode 20 is electrically positive with respect to cathode 18 so that electrons emitted from low work function material impregnated into the tube 28 of cathode 18 will be drawn along with electrons torn away from the hydrogen atoms flowing into the ion source through cathode 18 to the anode 20. The accelerator grid 16 is operated at negative potential to extract the beam and repel electrons in the exhaust. For ion energies exceeding about 10 Kev, staged ion optics consisting of 3 or more grids would generally be employed.

In operation, the ion souce 10 is evacuated and the cathode 18 is heated by the swaged heater 31 shown in FIG. 2. Hydrogen gas is then directed into the ion source as at 33 in FIG. 2 and passes through tube 28 which has been impregnated with a work function material such as barium calcium aluminate. Positive voltage pulses are applied between the igniter 19 and the cathode 18 causing ionization of the hydrogen as flowing through hollow cathode 18 and subsequent discharge ignition between cathode 18 and anode 20. The ions produced by the discharge drift to the screen grid and then are accelerated by the screen grid 15 and the accelerator grid 16.

While the ion source 10 as described utilizes hydrogen to generate hydrogen ions, deuterium can also be used.

It will be understood that changes and modifications may be made to the above-described ion source without departing from the spirit and scope of the invention as set forth in the claims appended hereto.

What is claimed is:

1. In a hydrogen ion source of the type comprising a chamber with an electron emitting cathode at the closed end thereof, an accelerator grid at the other end and an anode between the cathode and the accelerator grid, a screen grid being disposed between the anode and the accelerator grid, the improvement comprising:

a cylindrical metal baffle disposed coaxially around said cathode abutting said closed end;

a baffle disc positioned on the axis of said cathode, said disc being of smaller diameter than said cylindrical baffle, said disc being centered in said cylindrical baffle at the end opposite said closed end of the ion source;

said cathode comprising a porous tungsten tube impregnated with a low work function material and having an orifice plate at one end inwardly of the closed end of said ion source;

means for heating said tungsten tube to cause electron emission comprising heating coils swaged onto the outside of said cathode tube and a plurality of isolated layers of refractory metal foil disposed around the outside of said heating coils to efficiently heat the porous tube; and wherein hydrogen flows from a hydrogen supply through said cathode into said ion source;

a set of electromagnets to adjust discharge impedance and ionization efficiency and means for ionizing hydrogen flowing into said hydrogen ion source through said cathode.

2. The ion source of claim 1 wherein said baffle disc is from about 50% to 75% the diameter of said cylindrical baffle.

3. The ion source of claim 1 wherein said tungsten tube is inside a refractory metal cathode tube with a layer of electrically conductive refractory metal therebetween, said cathode tube having an annular radiation flange at one end and surrounding said orifice plate.

4. The ion source of claim 1 wherein said low work function material is barium calcium aluminate.

5. The ion source of claim 1 wherein said cylindrical baffle, said baffle disc and said anode are of refractory metal and are each thermally isolated from the electromagnets by a plurality of layers of radiation shielding.

6. The ion source of claim 1 wherein said radiation shielding is by separated layers of tantalum foil.

* * * * *